US008948576B2

(12) United States Patent
Logan et al.

(10) Patent No.: US 8,948,576 B2
(45) Date of Patent: Feb. 3, 2015

(54) COMPACT AIR HANDLER SYSTEM

(75) Inventors: Colby Logan, Grenada, MS (US); Howard Schmidt, Loganville, GA (US)

(73) Assignee: Advanced Distributor Products LLC, Grenada, MS (US)

( * ) Notice: Subject to any disclaimer, the term of this patent is extended or adjusted under 35 U.S.C. 154(b) by 808 days.

(21) Appl. No.: 12/984,349

(22) Filed: Jan. 4, 2011

(65) Prior Publication Data

US 2012/0168133 A1 Jul. 5, 2012

(51) Int. Cl.

| | |
|---|---|
| ***F24H 3/02*** | (2006.01) |
| ***F24F 3/044*** | (2006.01) |
| ***F24F 13/20*** | (2006.01) |

(52) U.S. Cl.

CPC ..... *F24F 3/0442* (2013.01); *F24F 13/20* (2013.01)

USPC ..... 392/360; 392/374; 392/379

(58) Field of Classification Search

None

See application file for complete search history.

(56) References Cited

U.S. PATENT DOCUMENTS

| | | | | | |
|---|---|---|---|---|---|
| 4,103,146 | A * | 7/1978 | Rampe | 392/360 |
| 4,336,442 | A * | 6/1982 | Starr | 219/400 |
| 5,042,576 | A | 8/1991 | Broadbent | |
| 5,066,850 | A * | 11/1991 | Kondo | 219/388 |
| 5,121,613 | A * | 6/1992 | Cox et al. | 62/419 |
| 5,207,074 | A * | 5/1993 | Cox et al. | 62/285 |
| 5,284,027 | A * | 2/1994 | Martin, Sr. | 62/291 |
| 6,698,215 | B2 | 3/2004 | Bush et al. | |
| 6,950,606 | B2 | 9/2005 | Logan et al. | |
| 7,185,513 | B2 | 3/2007 | Bush et al. | |
| 7,355,146 | B2 * | 4/2008 | Angelis et al. | 219/202 |
| 8,428,445 | B2 * | 4/2013 | Abbott | 392/360 |
| 2005/0147400 | A1 * | 7/2005 | Logan et al. | 392/360 |
| 2010/0326624 | A1 * | 12/2010 | Hancock | 165/47 |

* cited by examiner

*Primary Examiner* — Thor Campbell

(57) ABSTRACT

An air handler system comprising a cabinet housing a blower unit and a heat exchange unit. The blower unit and the heat exchange unit are located in a substantially same lateral dimension in the cabinet. The blower unit and the heat exchange unit are separated by a distance that provides for a substantially uniform flow of air through a vertically-orientated plane of the heat exchange unit when the blower unit is in operation.

20 Claims, 6 Drawing Sheets

COMPACT AIR HANDLER SYSTEM

TECHNICAL FIELD

This application is directed, in general, to air handlers, and methods of manufacturing thereof.

BACKGROUND

The indoor unit of an air conditioning system, which often is referred to as an air handler, typically includes multiple components that are located in a common cabinet. For certain applications, it is desirable to fit such components into a compact a cabinet while still maintaining efficient air handling capabilities.

SUMMARY

One embodiment of the present disclosure is an air handler system, comprising a cabinet housing a blower unit and a heat exchange unit. The blower unit and the heat exchange unit are located in a substantially same lateral dimension in the cabinet. The blower unit and the heat exchange unit are separated by a distance that provides for a substantially uniform flow of air through a vertically-orientated plane of the heat exchange unit when the blower unit is in operation.

Another embodiment of the present disclosure is a method of manufacturing an air handler system. The method includes providing a cabinet, attaching a blower unit to the cabinet and attaching a heat exchange unit to the cabinet. The blower unit and the heat exchange unit are located in a substantially same lateral dimension in the cabinet. The blower unit and the heat exchange unit are separated by a distance that provides for a substantially uniform flow of air through a vertically-orientated plane of the heat exchange unit when the blower unit is in operation.

BRIEF DESCRIPTION OF THE DRAWINGS

Reference is now made to the following descriptions taken in conjunction with the accompanying drawings, in which.

DETAILED DESCRIPTION

Embodiments of the present disclosure benefit from the discovery that the heat exchange and blower units of an air handler system can be substantially laterally co-located within a cabinet space without detrimentally affecting the air flow characteristics in the air handler. In particular, the judicious selection of the lateral distance between the heat exchange unit and blower unit facilitates having uniform and acceptably high air flow characteristics through the heat exchange unit, thereby providing acceptable heat transfer capabilities. Consequently, the cabinet of the air handler system can be substantially reduced in height compared to conventional air handlers with similar heat transfer capabilities. This, in turn, beneficially allows the air handler system to be located in a more compact cabinet space than hitherto feasible using conventional air handler systems where the blower is often located above the heat exchange unit.

Figure 1A:
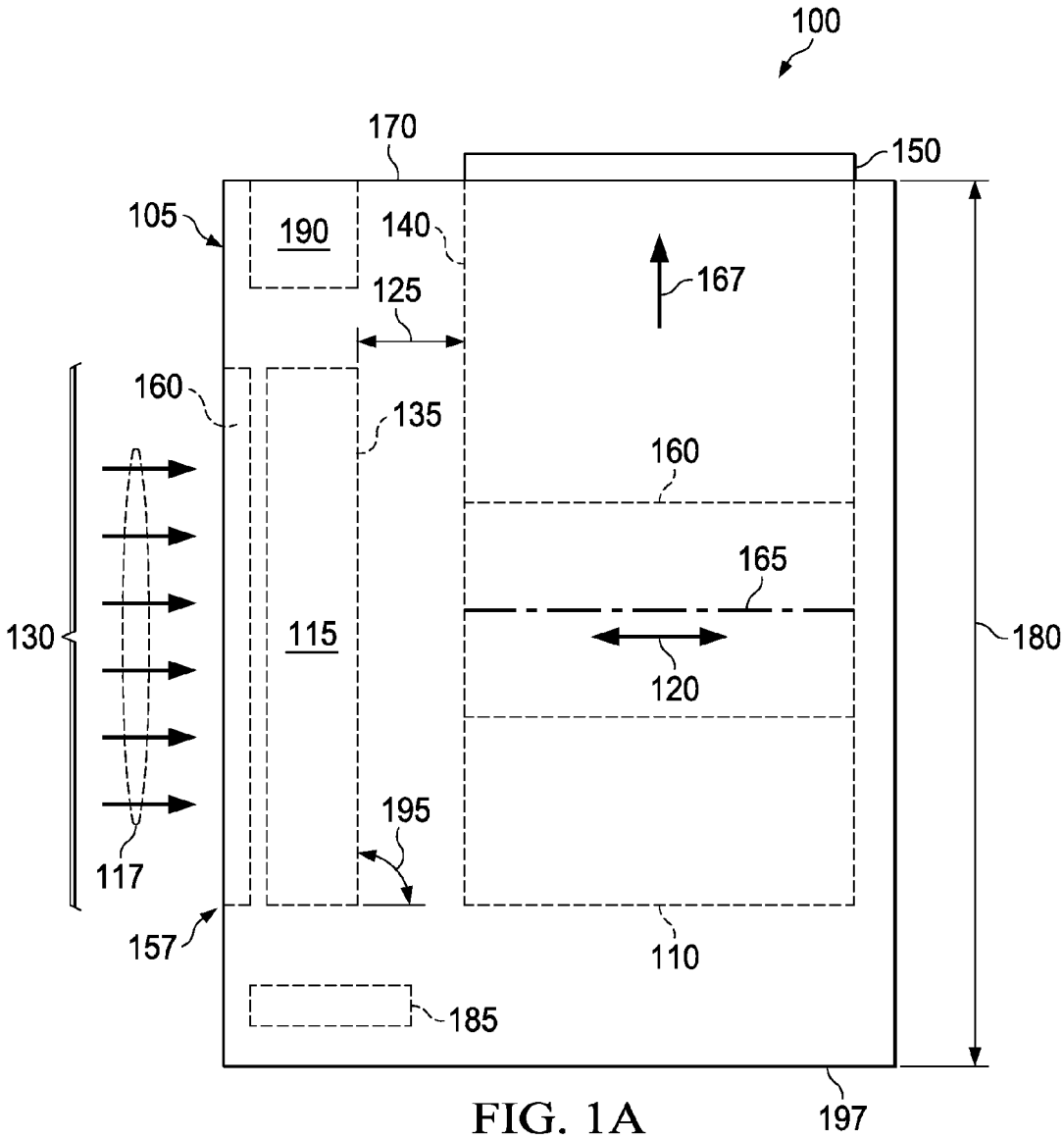
FIGS. 1A-1B present side views of example embodiments of air handler system of the disclosure.
Figure 1B:
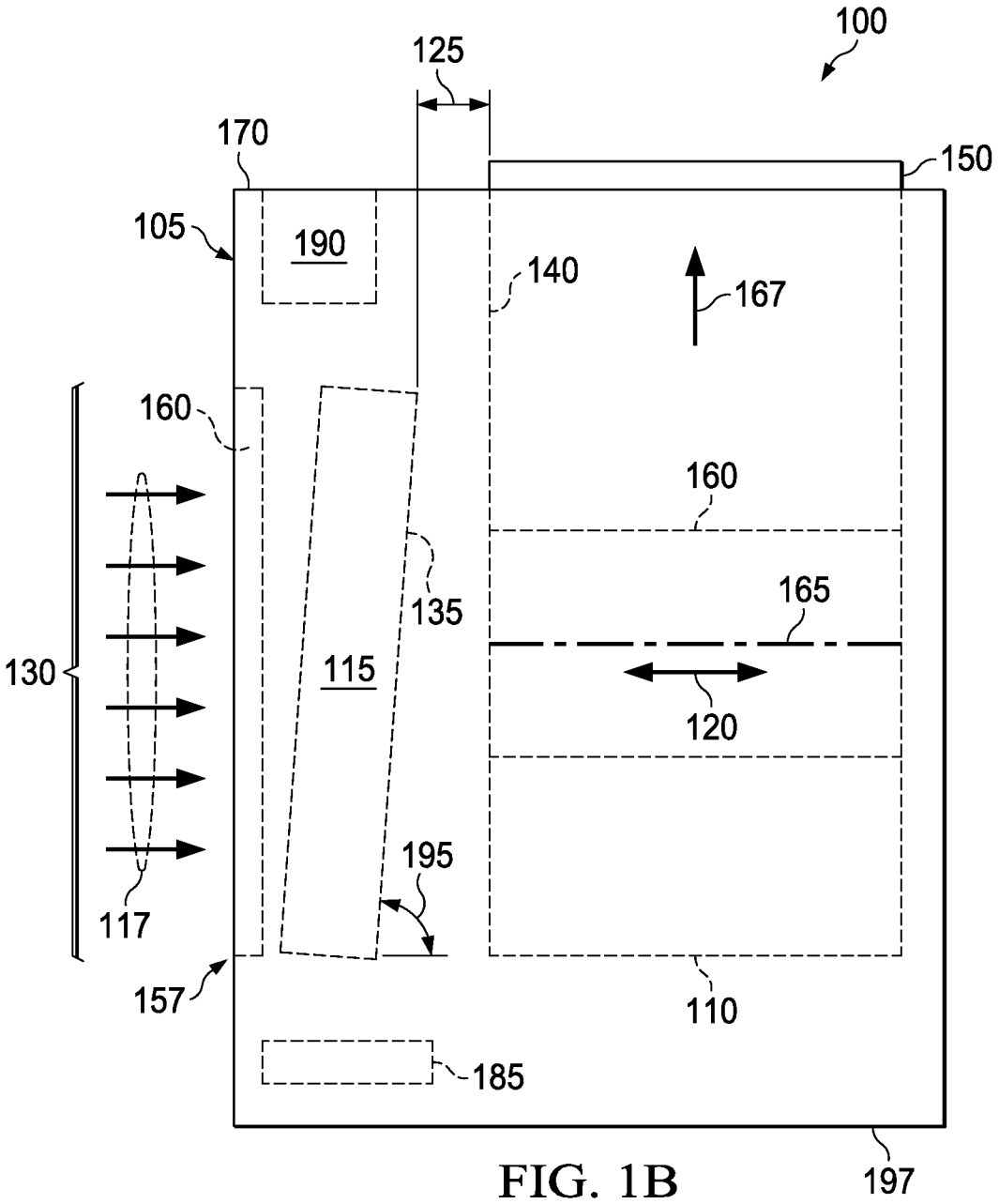
Figure 2A:
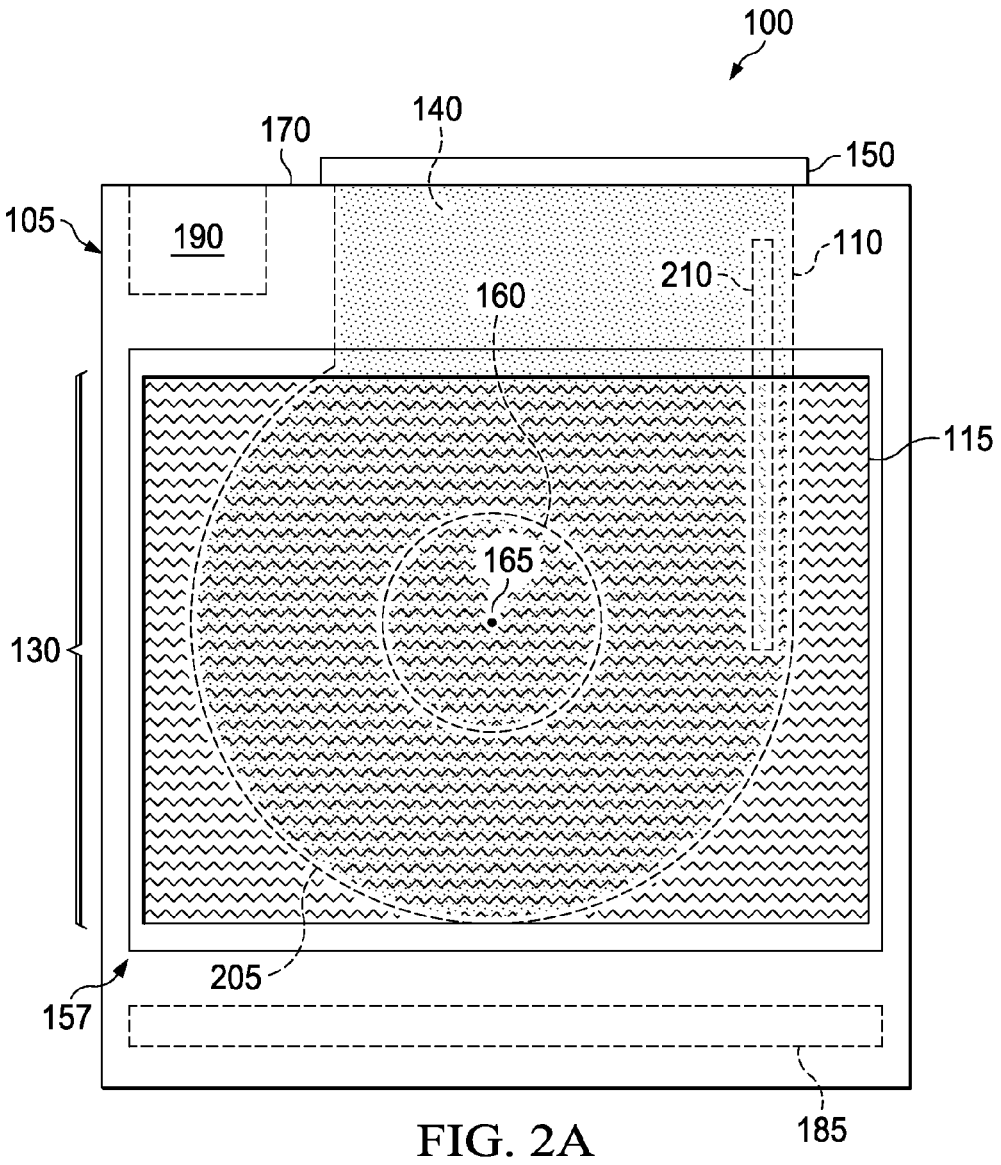
FIGS. 2A-2B present a front views of example embodiments of air handler systems of the disclosure, such as the systems depicted in FIGS. 1A-1B.
Figure 2B:
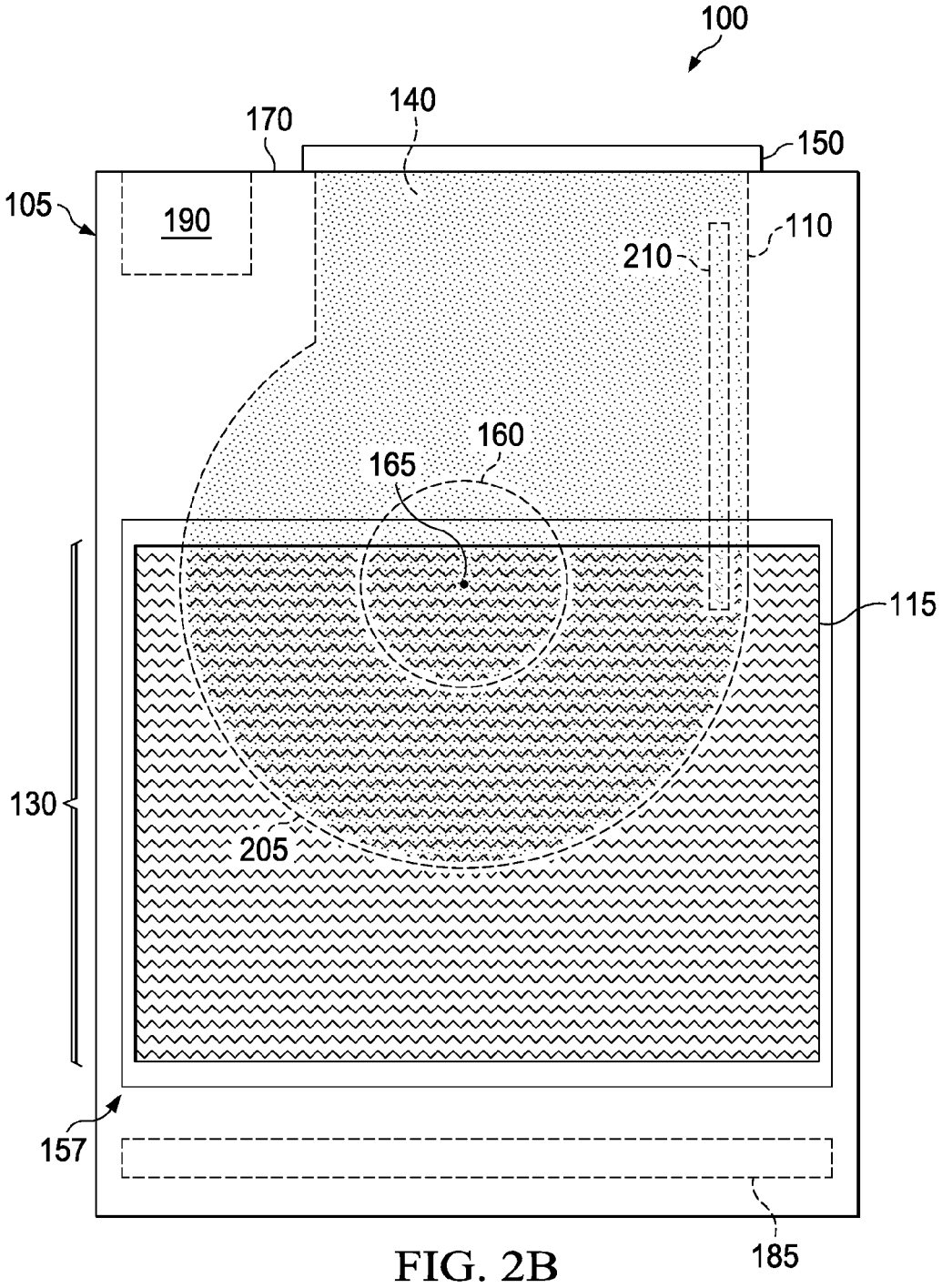

One embodiment of the present disclosure is an air handler system. FIGS. 1A-1B presents side views of example embodiments of an air handler system 100 of the disclosure. FIGS. 2A-2B presents a front view of example embodiments of the system 100, such as the systems depicted in FIGS. 1A-1B.

With continuing reference to FIGS. 1A and 2A, the system 100 comprises a cabinet 105 housing a blower unit 110 and a heat exchange unit 115. The blower unit 110 and the heat exchange unit 115 are located in a substantially same lateral dimension 120 in the cabinet 110. The blower unit 110 and the heat exchange unit 115 are separated by a distance 125 that provides for a substantially uniform flow of air 117 through a vertically-orientated plane 130 of the heat exchange unit 115 when the blower unit 110 is in operation.

The term, distance, as used herein, refers to the distance (e.g., distance 125 in FIGS. 1A and 1B) separating the outermost portion of the surface 135 of the vertically-orientated plane 130 of the heat exchange unit 115 that faces the blower unit 110 and the opposing outermost portion of the surface 140 of the blower unit 110.

The term "located in a substantially same lateral dimension" as used herein means that a substantial amount (e.g., at least about 10 percent) of the area of the vertically-orientated plane 130 of the heat exchange unit 115 projected in the lateral dimension 120, overlaps with the opposing vertically-oriented surface 140 of the blower unit. For instance, FIG. 2A depicts an example embodiment where the area 205 of lateral overlap of the plane 130 with the opposing vertically-oriented surface 140 of the blower unit 110 is at least about 90 percent. For instance, FIG. 2B depicts an example embodiment where the area 205 of lateral overlap of the plane 130 with the opposing vertically-oriented surface of the blower unit is at least about 50 percent.

For embodiments of the system 100, the fine adjustment of the distance 125 between the blower unit 110 and the heat exchanger unit 115 is an important and newly recognized result effective variable that affects the uniformity and absolute air flow through the heater exchanger unit.

In some cases, if the distance 125 is closer than the target value, then moisture can be undesirably pulled into duct work 150 (FIG. 1A) coupled to the cabinet 105, thereby detrimentally affecting humidity control by the air handler system 100. On the other hand, if the distance 125 is farther than the target value, then there is no longer a sufficiently uniformity or total flow of air through the heat exchanger unit 115, thereby deterring efficient heat exchange by the air handler system 100.

One of ordinary skill in the art would recognize that the actual target value depends upon several factors such as the sizes of the cabinet, blower unit, heat exchange. As such, the target value of the distance 125 is determined empirically for the particular air handler system 100 under consideration. For example, for some embodiments of the system 100, the distance 125 is at a value within about ±0.5 inches of a target value in a range of about 2 to 4 inches.

The term, substantially uniform flow of air, as used herein means that, when the blower unit 110 in operation, the velocity of air flow through any one of a two-percent or higher area portion (termed an "area cell" herein) of the vertically-oriented plane 130 is substantially the same as the velocity of air flow through any other two-percent or higher area portion of the vertically-oriented plane 130 of the heat exchange unit 115.

Figure 3:
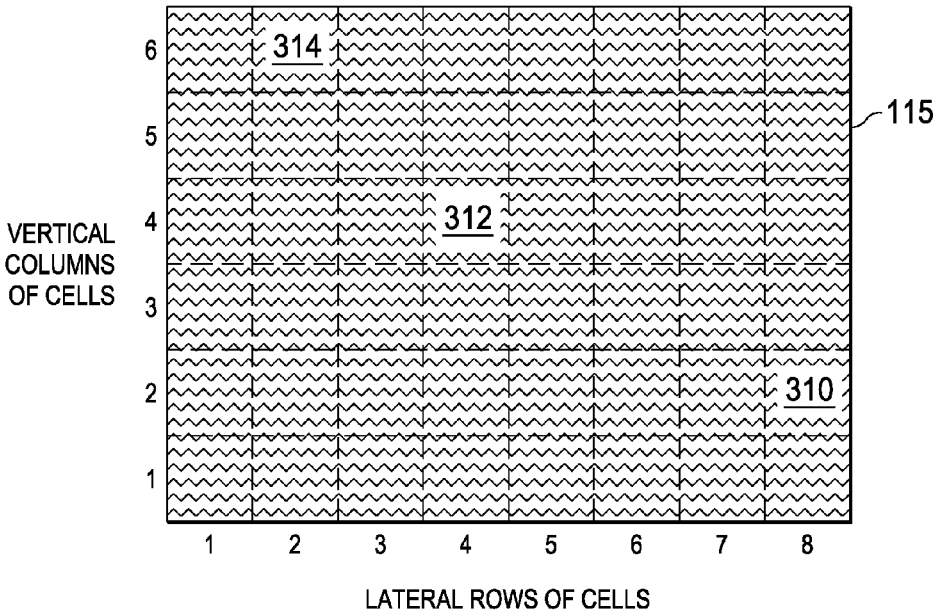
FIG. 3 presents a front view of an example heat exchanger of the air handler system, such as used in the systems depicted in FIGS. 1A-2B.

For instance, consider an example heat exchange unit 115 of the system 100, such as depicted in FIG. 3. An array of hypothetical area cells (e.g., area cells 310, 312, 314) are depicted on the vertically oriented plane 130. In some embodiments, when the blower unit 110 is operating, the adjusted distance 125 between the heat exchange unit 115 and blower unit 110 provides for a velocity of air, passing though any individual area cell (e.g., any one of area cells 310, 312, 314) of the vertically-oriented plane 130, that is within about 50 percent, and more preferably, within about 30 percent, of a velocity of air passing through any other individual area cell (e.g., any other one of area cells 310, 312, 314) of the vertically-oriented plane 130.

For instance, in some embodiments of the system 100, when the blower unit 110 is operating, the distance 125 between the heat exchange unit 115 and blower unit 110 provides for a velocity of air, passing though any individual area cell (e.g., area cells 310, 312, 314) of the vertically-oriented plane 130, that is a value within a range of about 400 to 800 cubic feet per minute.

In some embodiments of the system 100, when the blower unit is operating, the distance 125 between the heat exchange unit 115 and blower unit 110 provides for an average velocity of air passing through the vertically-oriented plane 130 of at least about 400 cubic feet per minute, and more preferably, an average velocity of at least about 475 cubic feet per minute.

Figure 4:
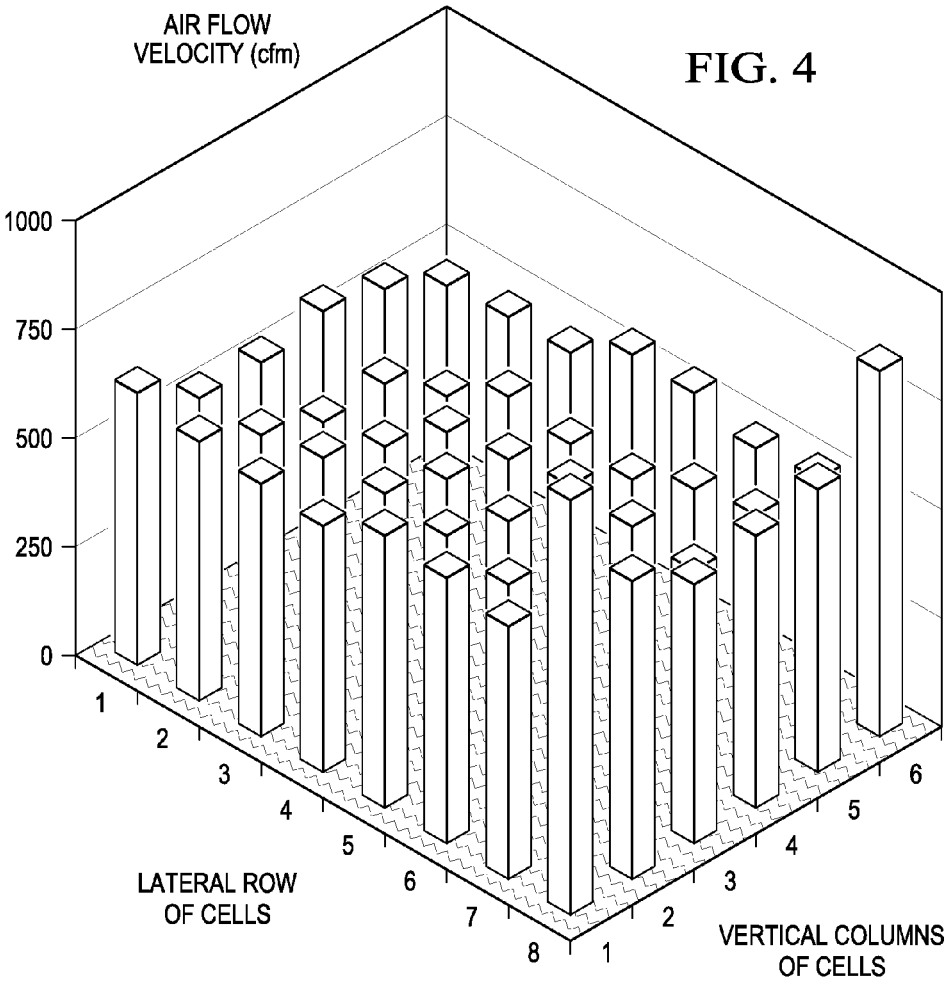
FIG. 4 presents an example air flow velocity profile through an example heat exchange unit of an air handler system of the disclosure when the blower unit of the system is in operation.

For illustrative purposes, FIG. 4 shows example results of measured air flow velocities for an example system 100 of the disclosure. Air flow passing through the 8 by 6 array of individual lateral and vertical area cells of a heat exchange unit 115. In this experiment, the area cells were defined as squares of 2 by 2 inches, such as depicted in FIG. 3. However, other shapes or sizes of area cells could be considered. The vertically-oriented plane 130 of heat exchanger 115 was 24×17 inches (width×height). The centrifugal blower unit 110, when in operation, produced an air pressure equal to a pressure of 0.3 static inches of water. The air flow velocity from each area cell was measured using an anemometer.

Various embodiments of the system 100 may have additional features which facilitate providing a compact design with the desired uniform and acceptably high air flow characteristics.

For some embodiments of the system 100, the heat exchanger 115 can advantageously include louvered fins, such as described in U.S. Pat. No. 5,042,576 which is incorporated in its entirety herein. It is believed that the plurality of slits present in such louvered fins helps to prevent condensate from being pulled up into duct work 150 (FIG. 1A) coupled to the cabinet 105. However, other embodiments of the system 100 could include heat exchanger units 115 having other types of fins configurations familiar to those skilled in the art, such as straight fins.

As further illustrated in FIGS. 1A-2B in some embodiments, to maximize air flow through the system 100, the vertically-orientated plane 130 of the heat exchanger 115 is in a substantially same lateral dimension 120 as a return air duct opening 155 of the cabinet 105. As also illustrated, some embodiments of the system 100 may further include a particle filter 160 located between the air duct opening 155 and the heat exchanger 115.

In some embodiments of the system 100, the blower unit 110, includes, or is, a centrifugal blower. In some cases, a rotating drum 160 of the centrifugal blower 110 is oriented such the axis of rotation of the drum 165 is perpendicular to the vertically-oriented plane 130, and air output 167 from the centrifugal blower 110 is directed to an air duct 150 located on a top side 170 of the cabinet 105. Other embodiments could include other types of blower units such a fan blower. Some embodiments of the blower unit 110 can further include an electrical heater unit 210. For example, the blower unit 110 can include an electric heater unit incorporated such as described in U.S. Pat. No. 6,950,606 which is incorporated in its entirety herein.

Some embodiments of the system 100, the cabinet 105 is configured as a wall-mounted cabinet. In some cases, to facilitate fitting the system 100 into a compact space, the cabinet 105 has a compact vertical height 180 of about 30 inches or less. For instance, in some cases the cabinet 105 is configured to be located in a closet, wherein the ceiling height of the closet equals about 8 feet. In some cases, the cabinet 105 can be located above a water heater that is also located inside the closet and which has a vertical height of about 36 inches.

One of ordinary skill in the art would appreciate that embodiments of the air handler system 100 could include other components to facilitate its operation. For example, the system 100 can include a drain pan 185 located below the heat exchanger unit 115. For example, the system 100 can include an electrical control board 190 that is configured to control the operation of the blower unit 110, the heat exchange unit 115 and other components of the system 100.

Figure 5:
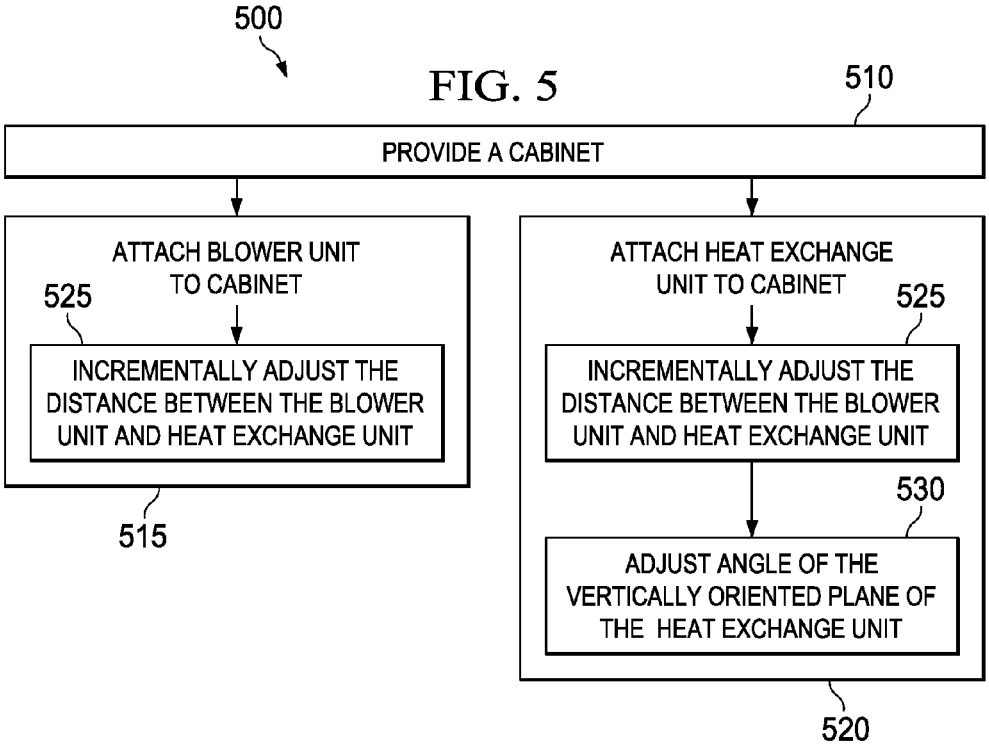
FIG. 5 presents a flow diagram of an example method of manufacturing an air handler system of the disclosure, such as any of the systems discussed in the context of FIGS. 1A-4.

Another embodiment of the present disclosure is a method of manufacturing an air handler system. FIG. 5 presents a flow diagram of an example method 500 manufacture. The method 500 can be used to manufacture any of the systems 100 discussed in the context of FIGS. 1A-4.

With continuing reference to FIGS. 1A-3 throughout, the example method 500 depicted in FIG. 5 comprises a step 510 of providing a cabinet 105, a step 515 of attaching a blower unit 110 to the cabinet 105, and a step 520 of attaching a heat exchange unit 115 to the cabinet 105. The blower unit 110 and the heat exchange unit 115 are located in a substantially same lateral dimension 120 in the cabinet 105. The blower unit 110 and the heat exchange unit 115 are separated by a distance 125 that provides for a substantially uniform flow of air 117 through a vertically-orientated plane 130 of the heat exchange unit 115 when the blower unit 110 is in operation.

In some embodiments of the method 500, attaching the heat exchange unit 115 to the cabinet 105 in step 520 can further include a step 525 of incrementally adjusting the distance 125. For each incrementally adjusted distance 125, measuring the velocity of air passing through different area cells (e.g., cells 310, 312, 316) of the vertically-orientated plane 130 when the blower unit 110 is in operation. For example, in some cases, incrementally adjusting the distance 125 includes incremental adjustments of about 0.5 inches or less.

In other embodiments of the method 500, however, the distance 125 could alternatively, or additionally, be adjusted in step 525 as part of attaching the blower unit 110 to the cabinet 105 (step 515).

In some embodiments of the method 500 attaching the heat exchange unit 115 to the cabinet 105 in step 520 can further include a step 530 of adjusting an angle 195 of the vertically-orientated plane 130. For example, in some embodiments, to facilitate attaining a more uniform air flow 117, or fitting the heat exchanger in a compact-height cabinet 105, it may be desirable to adjust the angle 195 to a value in a range of about ±5 degree from a perpendicular angle (e.g., an angle 195 in a range 95 to 85 degrees) with respect to a horizontal base 197 of the cabinet 105. Adjusting the angle 195 away from a perpendicular angle, however, is balanced against introducing excessive moisture into the output air flow 167 of the system 100.

One of ordinary skill in the art would appreciate that the method of manufacture 500 could further include attaching other components (e.g., ducts 150, 155, drain pan 185, control box 190) to the cabinet 105, or to other components of the system, to complete the manufacture of the system 100.

Those skilled in the art to which this application relates will appreciate that other and further additions, deletions, substitutions and modifications may be made to the described embodiments.

What is claimed is:

1. An air handler system, comprising:

a cabinet housing a blower unit and a heat exchange unit, wherein the blower unit and the heat exchange unit are located in a substantially same lateral dimension in the cabinet, the blower unit and the heat exchange unit are oriented in the cabinet such that air enters the cabinet along an air-intake pathway direction, through the heat exchange unit and into the blower unit, and, exits the blower unit and the cabinet in an air-output pathway direction, wherein the air-output pathway direction is perpendicular to the air-intake pathway direction, and a surface of the blower unit having an air-intake, through which the air enters the blower and travels along the air intake pathway direction, is separated from an opposing surface of the heat exchanger unit having an air-exit through which the air exits along the air intake pathway direction.

2. The system of claim 1, wherein, at least about 50 percent of the area of the opposing surface of the heat exchange unit overlaps in the lateral dimension with the surface of the blower unit.

3. The system of claim 1, wherein, at least about 90 percent of the area of the opposing surface of the heat exchange unit overlaps in the lateral dimension with the surface of the blower unit.

4. The system of claim 1, wherein, when the blower unit is operating, a distance separating the opposing surface of the heat exchange unit and the surface of the blower unit provides for a velocity of air, passing through any individual sub-area portion of the air-intake of the blower unit is within 30 percent of a velocity of air passing through any other individual same-sized sub-area portion of the air-intake of the blower unit wherein the individual sub-area portion and the other individual sub-area portion each correspond to about two-percent or higher of the total area of the air-intake of the blower unit.

5. The system of claim 4, wherein, when the individual sub-area portion corresponds to a 4 square inch area of the air-intake of the blower unit.

6. The system of claim 1, wherein, when the blower unit is operating, a distance separating the opposing surface of the heat exchange unit and the surface of the blower unit provides for a volume flow velocity of air, passing through any individual sub-area portion of the air-intake of the blower unit, that is a value within a range of about 400 to 800 cubic feet per minute.

7. The system of claim 1, wherein, when the blower unit is operating, a distance separating between the opposing surface of the heat exchange unit and the surface of the blower unit provides for an average volume flow velocity of air passing through the air-intake of the blower unit equal to at least about 400 cubic feet per minute.

8. The system of claim 1, wherein the distance is at a target value within about ±0.5 inches in a range of about 2 to 4 inches.

9. The system of claim 1, wherein the heat exchanger further includes louvered fins.

10. The system of claim 1, wherein the opposing surface of the heat exchanger is in a substantially same lateral dimension as a return air duct of the cabinet.

11. The system of claim 1, where the blower unit includes a centrifugal blower.

12. The system of claim 11, where a rotating drum of the centrifugal blower is oriented such that the axis of rotation of the drum is perpendicular to the opposing surface of the heat exchange unit and air output from the centrifugal blower along the air-output pathway direction is directed to an air duct located on a top surface of the cabinet.

13. The system of claim 1, where the blower unit further includes an electrical heater unit.

14. The system of claim 1, wherein the cabinet is configured as a wall-mounted cabinet.

15. The system of claim 1, wherein the cabinet has a vertical height of about 30 inches or less.

16. The system of claim 1, where the cabinet is configured to be located in a closet, wherein the ceiling height of the closet equals about 8 feet.

17. A method of manufacturing an air handler system, comprising:

providing a cabinet;

attaching a blower unit to the cabinet; and attaching a heat exchange unit to the cabinet, wherein the blower unit and the heat exchange unit are located in a substantially same lateral dimension in the cabinet, the blower unit and the heat exchange unit are oriented in the cabinet such that air enters the cabinet along an air-intake pathway direction, through the heat exchange unit and into the blower unit, and, exits the blower unit and the cabinet in an air-output pathway direction, wherein the air-output pathway direction is perpendicular to the air-intake pathway direction, and a surface of the blower unit having an air-intake, through which the air enters the blower and travels along the air intake pathway direction, is separated from an opposing surface of the heat exchanger unit having an air-exit through which the air exits along the air intake pathway direction.

18. The method of claim 17, wherein attaching the heat exchange unit to the cabinet further includes incrementally adjusting a distance separating the opposing surface of the heat exchange unit and the surface of the blower unit, and for each incrementally adjusted distance, measuring the velocity of air passing through different sub-area portions of the air-intake pathway direction exiting the heat exchange unit when the blower unit is in operation.

19. The method of claim 18, wherein adjusting the distance includes incremental adjustments of about 0.5 inches or less.

20. The method of claim 17, wherein attaching the heat exchange unit to the housing further includes adjusting an angle of the opposing surface of the heat exchange unit to a value in a range of about ±5 degree of a perpendicular angle with respect to a horizontal base of the cabinet.

* * * * *